US005082465A

United States Patent [19]

Wine

[11] Patent Number: 5,082,465

[45] Date of Patent: Jan. 21, 1992

[54] AIR THRUST PROPULSION BOAT-DRIVE TRAIN

[76] Inventor: David E. Wine, The Penthouse South, 2200 N. Atlantic, Daytona Beach, Fla. 32018

[21] Appl. No.: 357,017

[22] Filed: May 25, 1989

[51] Int. Cl.[5] ..... B63H 37/00

[52] U.S. Cl. ..... 440/37; 416/189

[58] Field of Search ..... 440/37; 416/55, 63, 416/85, 131, 179, 189, 244 R

[56] References Cited

U.S. PATENT DOCUMENTS

| | | | |
|---|---|---|---|
| 1,053,876 | 2/1913 | Riley et al. . | |
| 2,272,661 | 2/1942 | Finley . | |
| 2,341,911 | 2/1944 | Drexler et al. . | |
| 2,948,250 | 8/1960 | Peterson . | |
| 2,972,327 | 2/1961 | Paul | 440/37 |
| 3,149,605 | 9/1964 | Broadwell | 440/51 |
| 3,270,827 | 9/1966 | Mantle | 440/37 |
| 4,005,673 | 2/1977 | Carrero . | |
| 4,015,555 | 4/1977 | Tinkham . | |

FOREIGN PATENT DOCUMENTS

| | | |
|---|---|---|
| 224515 | 4/1959 | Australia . |
| 996477 | 6/1965 | United Kingdom . |

OTHER PUBLICATIONS

Richard E. Hayden, "Some Advances in Design Techniques for Low Noise Operation of Propellers and Fans", *Noise Con 77*, NASA Langley Research Center, Hampton, Va., pp. 381-396.

*Primary Examiner*—Sherman Basinger
*Assistant Examiner*—Stephen P. Avila
*Attorney, Agent, or Firm*—Venable, Baetjer, Howard & Civiletti

[57] ABSTRACT

A drive train for an air thrust propulsion boat which has a propeller encircled by a noise reducing and efficiency increasing shroud. The shroud and propeller rotate about a generally vertical axis providing steering control for the boat. A plurality of rudders are attached to the rearward side of the propeller shroud in the slipstream of the propeller and serve as a secondary means for steering the boat. An engine which powers the propeller is remotely positioned from the propeller giving the boat a lower center of gravity. Connected to the engine is an automotive type automatic transmission which gives the boat both forward and reverse motion capabilities.

69 Claims, 10 Drawing Sheets

AIR THRUST PROPULSION BOAT-DRIVE TRAIN

BACKGROUND OF THE INVENTION

1. Field of the Invention

The invention relates generally to air thrust propeller driven boats. More particularly, the invention relates to a drive train for an air thrust propeller driven boat.

2. Description of the Related Art

Air thrust propeller driven boats, or "air boats" as they are commonly known, have found wide application and acceptance in areas where shallow water, reeds, everglades, partially frozen lakes and sub-surface debris present hazards to the operation of a submersed propeller. A significant advantage associated with air boats is their ability to hydroplane over the water's surface, and therefore to require no significant water depth for effective operation.

An air boat operates generally on the principle that once a certain speed is reached, the hull of the boat hydroplanes over the surface of the water, having relatively little impact on whatever lies beneath the surface of the water. Reaching the speed necessary for hydroplaning, or "getting up on the plane", as it is generally termed in the vernacular, requires a significant amount of power depending on the size and weight of the boat.

Typically, an air boat is powered by an aircraft engine mounted high above the water line of the boat hull to provide adequate clearance for the rotating propeller. Aircraft engines used in air boats are generally expensive, heavy, extremely powerful, noisy and generally have poor fuel economy. Further, the propeller is normally directly coupled to the engine crankshaft. There are several disadvantages to this configuration.

The propeller, when coupled directly to the crankshaft, rotates whenever the engine is running, generally making engine idling without forward motion difficult due to the continued air thrust being produced. Also, having a direct coupling between the propeller and the engine limits the boat's mobility in that only forward motion is possible. Further, because of the elevated mounting f the engine above the hull water line, the center of gravity of the air boat is high and rearward, making the boat unstable and unsafe under many operating conditions.

The typical propeller used in air boats is a two blade aircraft propeller not specifically designed for use in a marine application. The blade angle and curvature is not necessarily the most efficient, quietest or safest design for marine applications. Further, aircraft propellers are relatively long measured from blade tip to blade tip. When the propeller is rotating at maximum speed, the tip generates shock waves which produce a significant amount of noise making conversation between passengers virtually impossible, and fatiguing the operator.

Air boat propellers are usually protected by an open wire mesh cage shroud that serves to protect boaters and fowl from the dangers associated with a rotating propeller. The random momentum of incoming air on the upstream side of a propeller has a significant effect on the efficiency of the propeller. The typical propeller shroud does little to improve the efficiency of the propeller with respect to the incoming air.

The maintenance of an air boat having an aircraft engine presents considerable problems for the owner and/or operator. Aircraft engines are generally expensive to repair and aircraft mechanics are somewhat reluctant to work on a marine craft. Parts for aircraft engines are generally more expensive than comparable parts used in automotive and marine applications.

Steering of air boats has been accomplished by rudders of either the conventional submerged type or the aircraft type mounted in the slipstream of the propeller. The operation of submerged rudders is objectionable because any submerged movable part is subject to hazards such as sub-surface debris, rocks, etc. The use of a slipstream-mounted rudder is disclosed in U.S. Pat. No. 4,015,555. The use of such rudders can be disadvantageous since they are inefficient and are characterized by sluggish response because they are dependent upon the deflection of air.

Another method of steering an air thrust propeller driven boat consists of changing the direction of thrust by turning both engine and propeller together about a vertical axis, as disclosed in, for example, U.S. Pat. No. 4,005,673. This method is undesirable because of the instability associated with the elevated mounting of a heavy engine. Steering by turning both the propeller and engine as a unit has the additional disadvantage of offering no inherent self-centering characteristics. Once turned, this type of steering mechanism will continue to turn the boat until such time as the operator returns the mechanism to a centered position. The lack of a self-centering characteristic makes following a set course tiresome for the operator.

Yet another method of steering an air thrust propeller driven boat consists of an engine coupled via a combination of shafts and gears to a pivoting propeller support structure, as shown in U.S. Pat. No. 2,341,911. This design is disadvantageous due to its inherent complexity and because the vertical drive shaft coupling the engine and propeller may tend to induce rotation in the pivoting propeller support structure.

In general an air boat having an elevated engine mounted in the stern or rear of the hull can be difficult to control when there is a loss of power at high speed operation. At high speed, after engine shutdown or failure, the center of gravity of the boat, which is typically both high nd rearward, will continue in a forward direction with the boat. The hull of the boat, due to air resistance at high speeds and due to increasing water friction as the boat lowers into the water from a hydroplaning position, may tend to turn broadside, thus exposing one side of the boat to increased water resistance, thereby causing the boat to roll over and possibly injure passengers or the operator.

SUMMARY OF THE INVENTION

In one embodiment of the invention, the drive train includes an engine mounted on the hull of the boat; a support member coupled to the hull, the support member having a central longitudinal axis which falls in a vertical plane and which axis, if extended, would pass through the centerline of the hull, the support member being inclined from its lower end to its upper end toward the stern of the hull; a housing mounted for rotational movement at the upper end of the support member, the housing having limited rotational movement about the central longitudinal axis of the support member; a propeller having at least one blade, the propeller being connected to a shaft housed in and supported by the housing and the propeller being rotatably powered by the engine; a shroud encircling the propeller, the shroud being attached to the housing by a plurality of spokes which extend radially and outwardly from the housing; and a plurality of rudders coupled to the shroud for pivotal movement about generally vertical axes, respectively, the rudders being disposed in the slipstream region of the propeller.

The support member is in the form of a generally cylindrical tube, with a hollow interior. The support member has upper and lower ends. The interior surface of the support member has two flanges. Each flange is formed with a cylindrical bore hole. The axes of these bore holes are aligned with each other. The first upper flange is disposed adjacent the upper end of the support member and the second lower flange is disposed adjacent the lower end of the support member. A steering shaft extends through these bore holes in the flanges and through the bore of the support member. At its upper end, the steering shaft is rigidly secured to the lower portion of the housing. A thrust bearing is disposed on and supported by the flat upper surface of the upper flange, and rotatably supports the steering shaft and housing. A lever arm is fixed to the lower end of the steering shaft. A double acting push-pull type hydraulic cylinder hydraulically connects the lever arm to a steering stick that is located in a central portion of the boat. The steering stick is used to control the angular displacement of the housing, and with it the propeller, shroud, and rudders, and hence to steer the boat.

The pivotal movement of the rudders is slaved to the turning movement of the housing, by a cable such that when the housing is angularly displaced, the rudders are also angularly displaced.

The invention further relates to an air boat with means for selectively changing the direction of the rotation of the propeller, to permit the boat to be impelled in the rearward (reverse) direction. This is accomplished by an automobile-type automatic transmission operably connected to the engine.

Within the bore of the support member are disposed means for transmitting power from the transmission to the propeller. The power transmitting means, in one embodiment, includes an endless drive belt and pulley configuration. A first pulley is operably connected to the output shaft of the transmission. The second pulley is fixed to a shaft in the housing and transmits power to the propeller. Both pulleys are mounted to rotate about axes that are centered about and perpendicular to the central longitudinal axis of the support structure. The endless belt is disposed for rotation about both pulleys, to cause them to rotate. .Further, the endless belt is centered about the central longitudinal axis of the support structure.

The invention further relates to a quiet propulsion drive train system which includes a noise reduction material contained within a propeller shroud which encircles the propeller, and a swept back propeller blade design which minimizes and more equally distributes the shock waves produced by the propeller blade.

The invention further relates to a drive train system which includes a propeller shroud which increases the efficiency of the propeller thrust.

The apparatus of the present invention further includes means for increasing the efficiency of the air thrust produced by the propeller. Thus a generally unidirectional flow of air into the inlet side of the propeller is induced by a plurality of cylindrical rings that are disposed on the inlet side of the propeller in concentric relation to each other, coaxially with the axis of rotation of the propeller.

The invention further relates to a steering apparatus for an air thrust propeller driven boat with means for maintaining directional stability in the event of power loss at high speeds. Directional stability is provided by the shroud encircling the propeller, the rudders, and the cylindrical rings, all of which direct air flow when the boat is in motion and thus provide the boat with maneuverability in the event of engine failure at a high speed.

The invention further relates to an air boat having a braking mechanism operably coupled to the propeller shaft for decreasing the speed of rotation of the propeller, thereby using the propeller to create drag.

The invention further relates to an air thrust propeller boat having means of deflecting the air thrust of the propeller downwardly, to assist in providing lift and for further helping to get the boat up into its hydroplaning position.

BRIEF DESCRIPTION OF THE DRAWINGS

The several features of the present invention will be more clearly understood from the following detailed description when read in conjunction with accompanying drawings, in which.

DETAILED DESCRIPTION OF THE PREFERRED EMBODIMENT

Figure 1:
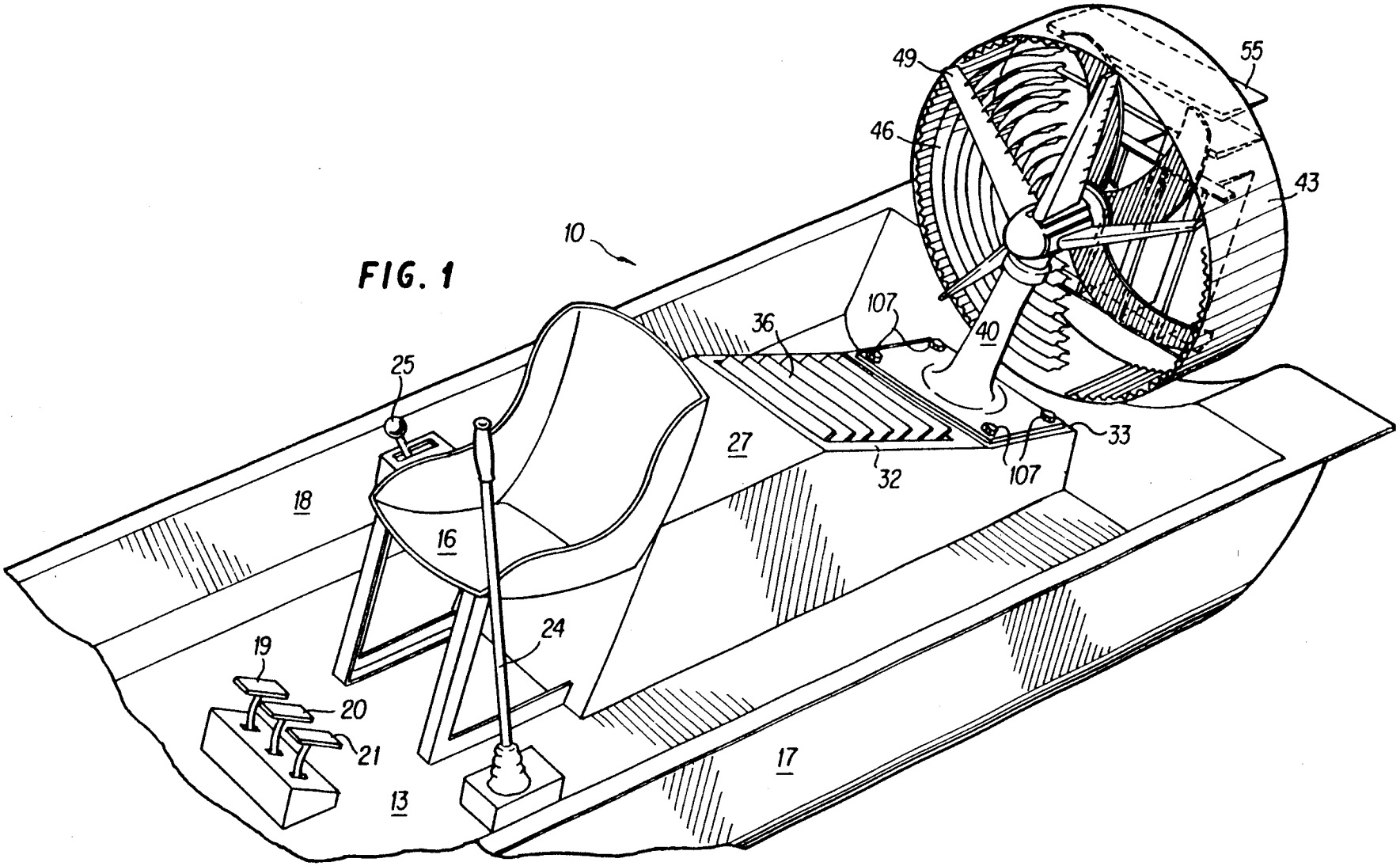
FIG. 1 is a fragmentary perspective view of the aft end of an air thrust boat constructed in accordance with one embodiment of the present invention.
Figure 2:
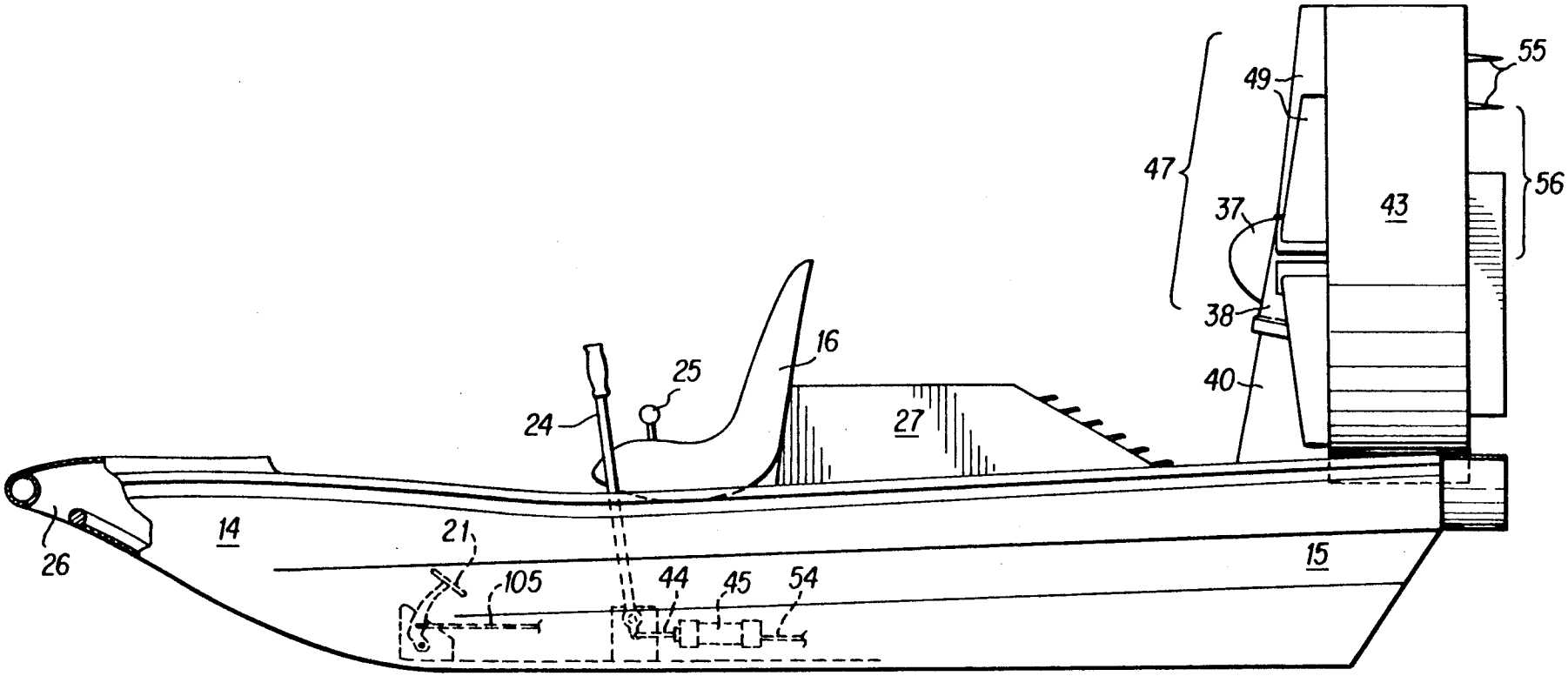
FIG. 2 is a side elevation, on a reduced scale, of the air thrust boat, including in phantom detail, some of the control mechanisms.

Referring now in detail to the drawings by numerals of reference, wherein like numerals represent like components throughout the drawing figures, and with particular reference to FIGS. 1 and 2, an air thrust propeller driven boat representing one embodiment of the present invention is depicted and designated generally by the reference numeral 10.

The boat 10 includes a hull 13 having a bow region 14 (FIG. 2), a stern region 15, port side 17, starboard side 18 (FIG. 1), and an operator's chair 16 that is preferably mounted slightly forward of midships. The hull 13 is preferably like that further described in a co-pending application titled "Boat Hull" Ser. No. 377,270 filed on July 10, 1989, which is incorporated herein by reference. The co-pending application "Boat Hull" includes a detailed description of hull 13 and further includes a description of the double bottom hull section 12 that is partially shown in FIG. 3*a*. An apparatus for providing reduced friction between the water surface and the bottom of the double bottom hull section 12 is also disclosed in this copending application. Exhaust gas from the engine 31 is diverted through a conduit (not shown) to the double bottom hull 12. The double bottom hull 12 includes a plurality of apertures (not shown) through which the exhaust gas is released, providing lift to the hull 13. The exhaust gas vented through the plurality of apertures (not shown) provides a gas boundary layer which reduces drag between the bottom of the hull and the surface of the water. An air inlet 26 (FIG. 2) in the bow region 14 directs air through a tunnel (not shown) to the engine 31 and under the engine cover 27 as is further disclosed in the copending application.

From the operator's chair 16 there is access to three foot pedal controls 19, 20 and 21 respectively, transmission shift mechanism 25, and to a steering stick 24, as generally depicted in FIGS. 1 and 2. The foot pedals 19, 20 and 21 and the transmission shift mechanism 25 are coupled in conventional fashion to elements within the structure of the boat by cables as will be described presently. For instance, a cable 105 (FIG. 2) connects the movement of the foot pedal 21 to the several air foils 55, as will be described in greater detail presently. The movement of the steering stick 24 is hydraulically connected to a lever arm 91 (FIG. 3*a*) by a rod 44 (FIG. 2) that is connected to a master cylinder 45, as will also be described presently.

Preferably immediately behind the operator's chair 16 is an engine cover 27 which extends rearward toward the stern region 15 of the boat hull 13. The upper surface of the engine cover 27 has a fore segment 32 and an aft segment 33 that provides a rear deck. The fore segment 32 of engine cover 27 includes louvers 36 which define openings 28 (FIG. 3*a*) that allow air flow under the engine cover 27 and through radiator 39. A support member 40 is mounted on the aft segment 33. A bullet shaped housing 37 having a cover 38 is mounted on the upper end of the support member 40, for limited rotary movement relative to the support member 40, as will be described presently.

Figures 3A, 3D:
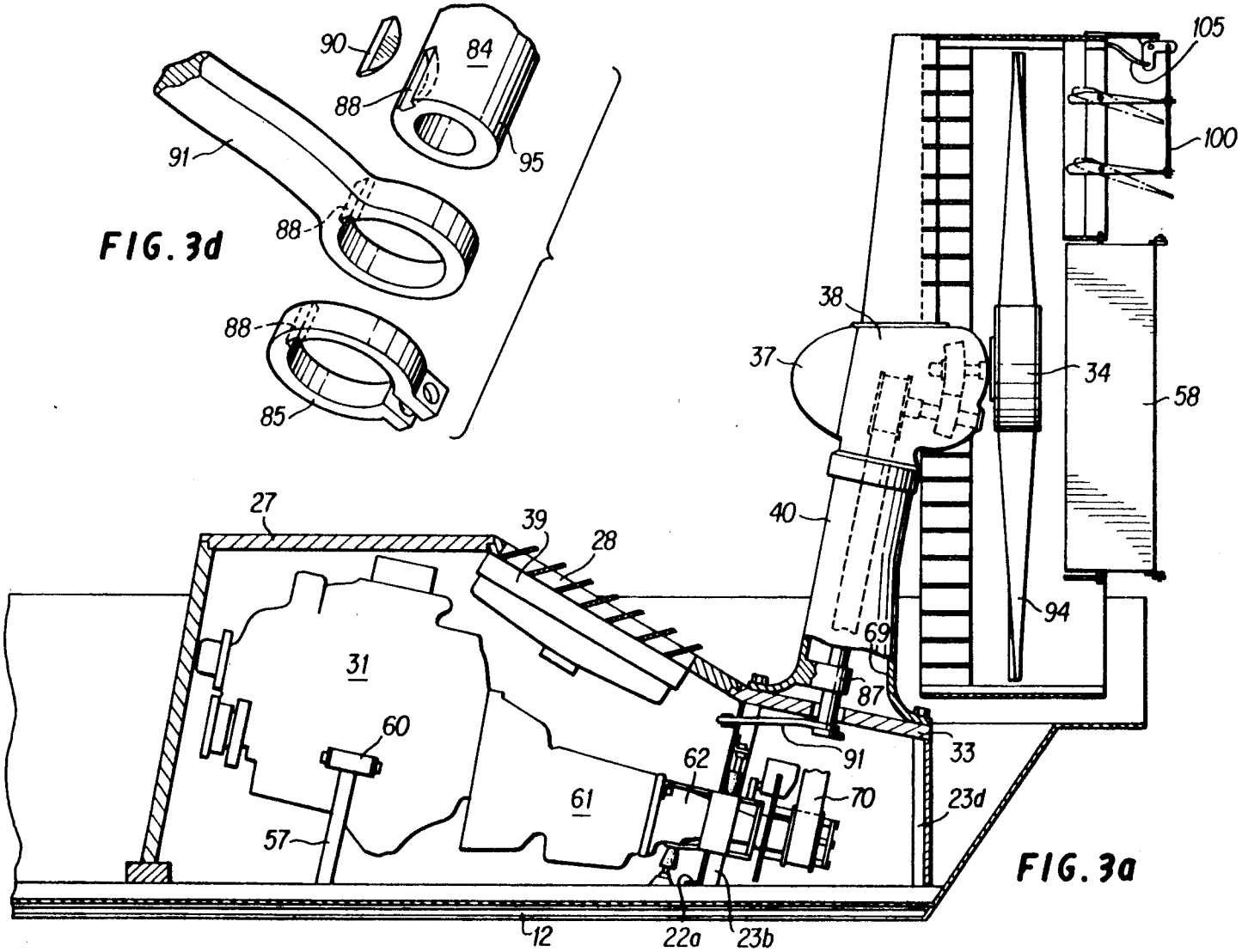
FIG. 3*a* is a fragmentary part elevation, part section in a vertical plane passing through the centerline of the boat, on an enlarged scale, of the drive train, showing the engine compartment, the support member, the housing, the shroud, and the air foils.
FIG. 3*d* is a fragmentary perspective view of the lower end of the steering shaft showing the notches in the steering shaft, steering arm and friction clamp, and the key way.
Figure 3B:
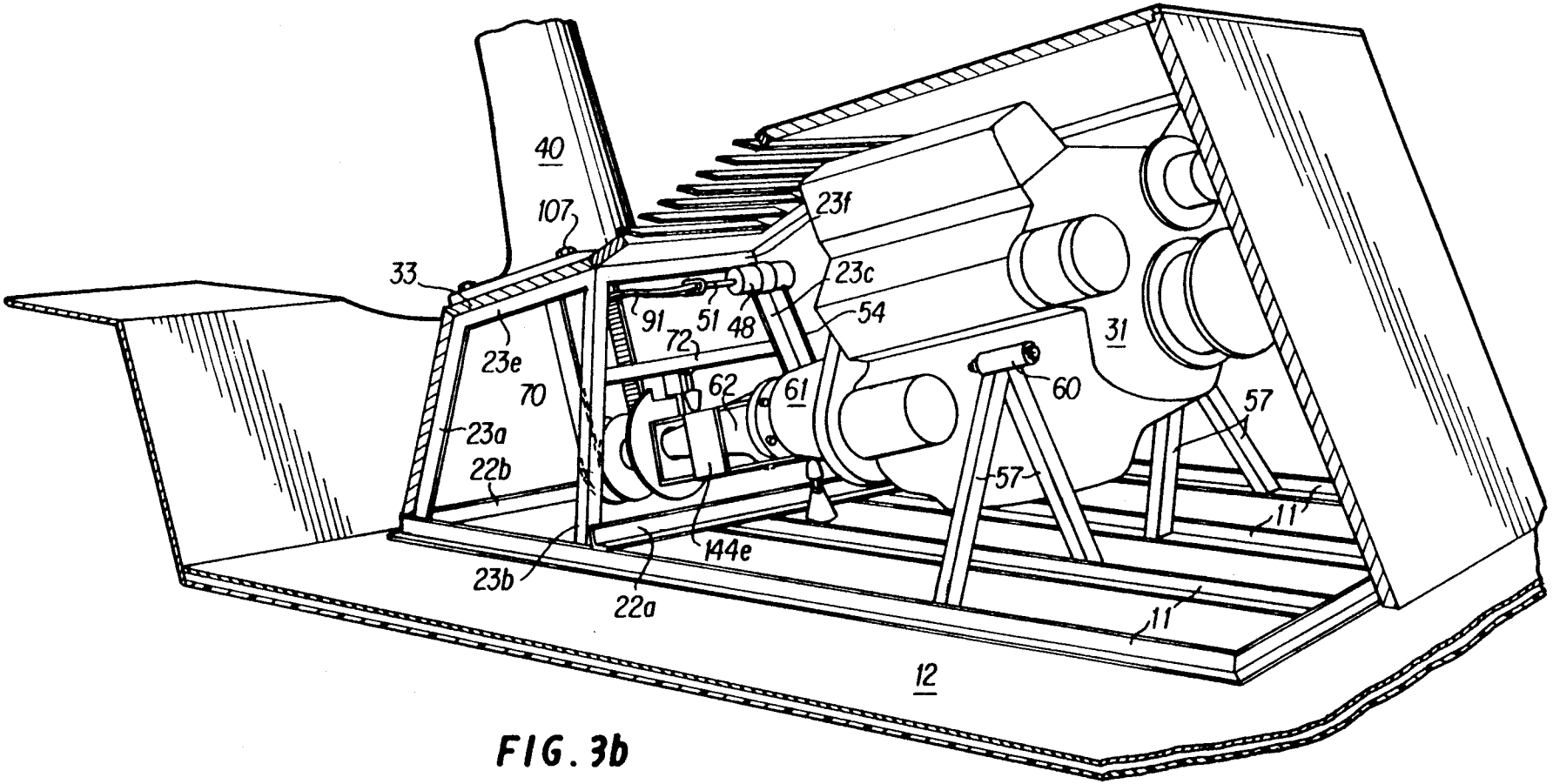
FIG. 3*b* is a fragmentary perspective view of the aft end of the air boat, on an enlarged scale, with a portion of the engine cover removed, showing the transmission and the support structure on which the support member is mounted.

Referring now to FIGS. 3*a* and 3*b*, several stringers 11 are welded to the double bottom hull section 12 of the hull 13, to extend lengthwise of the hull, and to rigidify and provide structural support for the hull 13. A support structure 23 is bolted near the aft end of the boat 10 to the stringers 11, as shown in FIG. 3*b*. The support structure 23 is composed of a number of metallic bars 23*a–h* bolted together to form a trapezoidal box-like rigid frame which support the aft deck 33 and the support member 40. The lower end of the bars 23*a* and 23*d* are bolted to the aft end of the stringers 11. The lower end of the bars 23*b* and 23*c* are also bolted to the stringers 11 slightly forward of the bars 23*a* and 23*d*. A square upper structure of the support structure is composed of the bars 23*e*, 23*f*, 23*g* (not shown) and 23*h* (not shown). A strong bar 22*a* is welded to the bottommost end of the bars 23*b* and 23*c* and is also bolted to the stringers 11. The strong bar 22*b* likewise is welded to the bars 23*a* and 23*d* towards the aft end of the support structure 23. The strong bar 22*b* is also bolted to the stringers 11. The support structure 23 further includes a cross member 72 which is welded to bars 23*b* and 23*c*. The engine cover 27, fore segment cover 32, and the radiator 39, have been partially removed in FIG. 3*b* for clarity.

An engine 31 (FIG. 3*a*), preferably an automobile engine such as a Ford 302 cubic inch displacement engine, is mounted on the decks of the boat beneath the cover 27. Two engine support brackets 57 symmetrically positioned on either side of the engine 31 are bolted to the stringers 11 and provide rigid support for resilient-type engine mounts 60 which cushion the engine 31 and reduce vibration. An automobile-type automatic transmission 61, such as a Ford C-4 automatic transmission, is secured to the aft end of the engine 31. This transmission is selectively operable in forward, neutral, and reverse directions, with its output being available through a splined drive shaft 63 (FIG. 3*c*) that projects through the tail shaft housing 62 of the automatic transmission 61. The transmission shift mechanism 25 is connected to the transmission 60 by a cable (not shown) in conventional fashion.

Figure 3C:
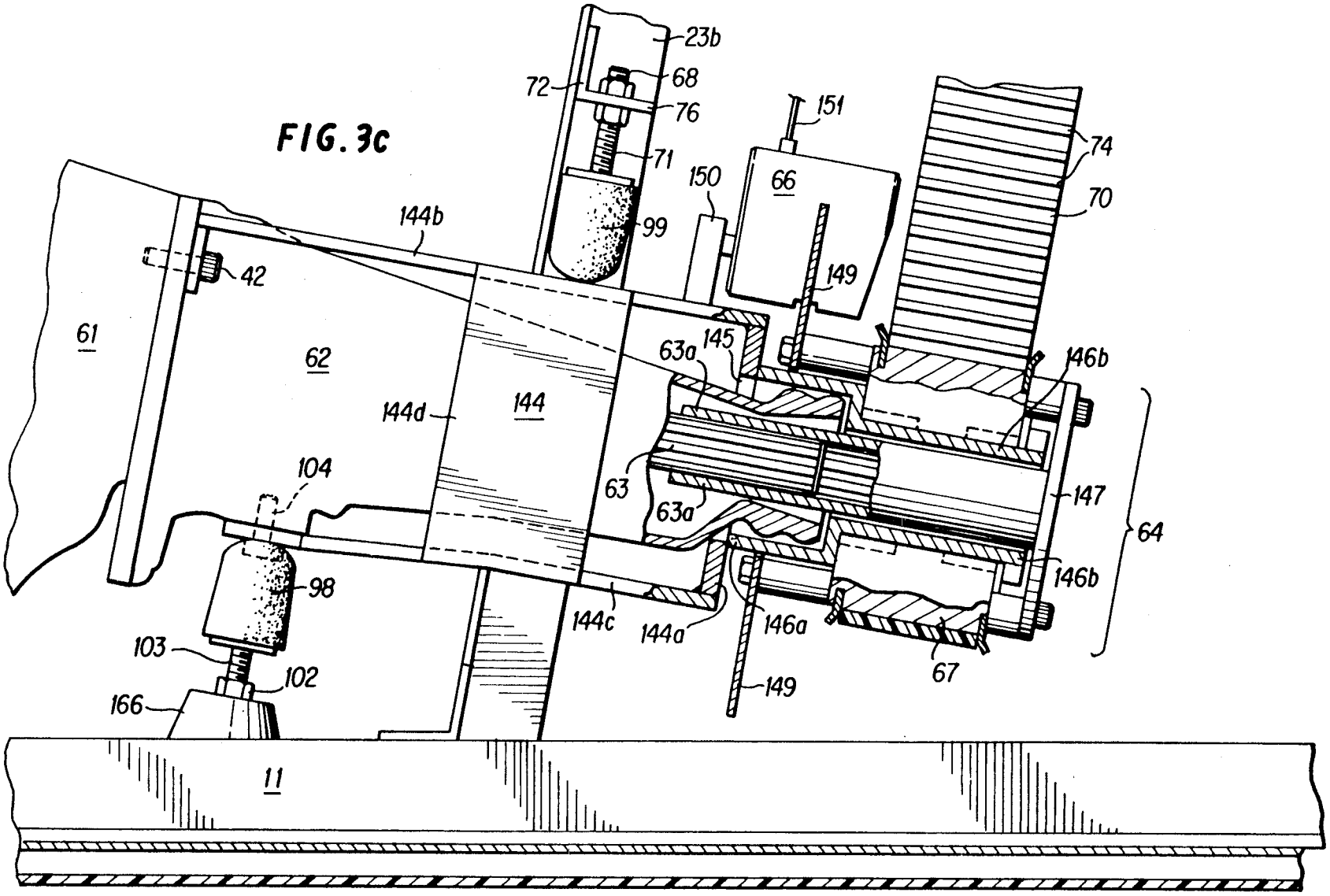
FIG. 3*c* is a fragmentary part side elevation, part axial section, of the bearing housing which supports the lower pulley.

A bearing housing 64 (FIG. 3*c*) is secured to the tail shaft housing 62 by bolts 42 (FIG. 3*c*). The bearing housing 64 includes a somewhat U-shaped bracket 144. The U-shaped bracket 144 is composed of several plate members which have been welded to one another. The U-shaped bracket 144 has a generally vertical member 144*a* to which generally horizontal upper member 144*b* and horizontal lower member 144*c* have been welded. Generally, vertical element 144*d* is welded to elements 144*b* and 144*c* for providing structural rigidity. A corresponding generally vertical member 144*e* (FIG. 3*b*) is welded to 144*b* and 144*c* on the port side of bracket 144.

Referring again to FIG. 3*c*, the base of this U-shaped bracket 144 is formed with an aperture 145 in vertical member 144*a*. A sleeve 146*a* is welded to the vertical member 144*a*, such that the bore of the sleeve 146*a* is aligned with the aperture 145 in the member 144*a*. A second sleeve 146*b* having a diameter smaller than that of the sleeve 146*a* is welded to sleeve 146*a*. An internally splined shaft 63*a* extends through both the aperture 145 in the bore of the sleeves 146*a* and 146*b*. A plate 147 is welded to one end of the internally splined shaft 63*a*. The plate 147 is bolted to the pulley 67. The pulley 67 is disposed about bearing 148 which supports the pulley 67, plate 147 and shaft 63*a* for rotary movement about the sleeve 146*b*.

The internally splined shaft 63*a* coaxially engages and surrounds the splined output shaft 63, disposed within the tail shaft housing 62 of the transmission 61, such that the shaft 63*a* acts as a female counterpart to male part shaft 63. The shaft 63*a* is supported in bushings (not shown) in tail shaft housing 62.

Figure 4:
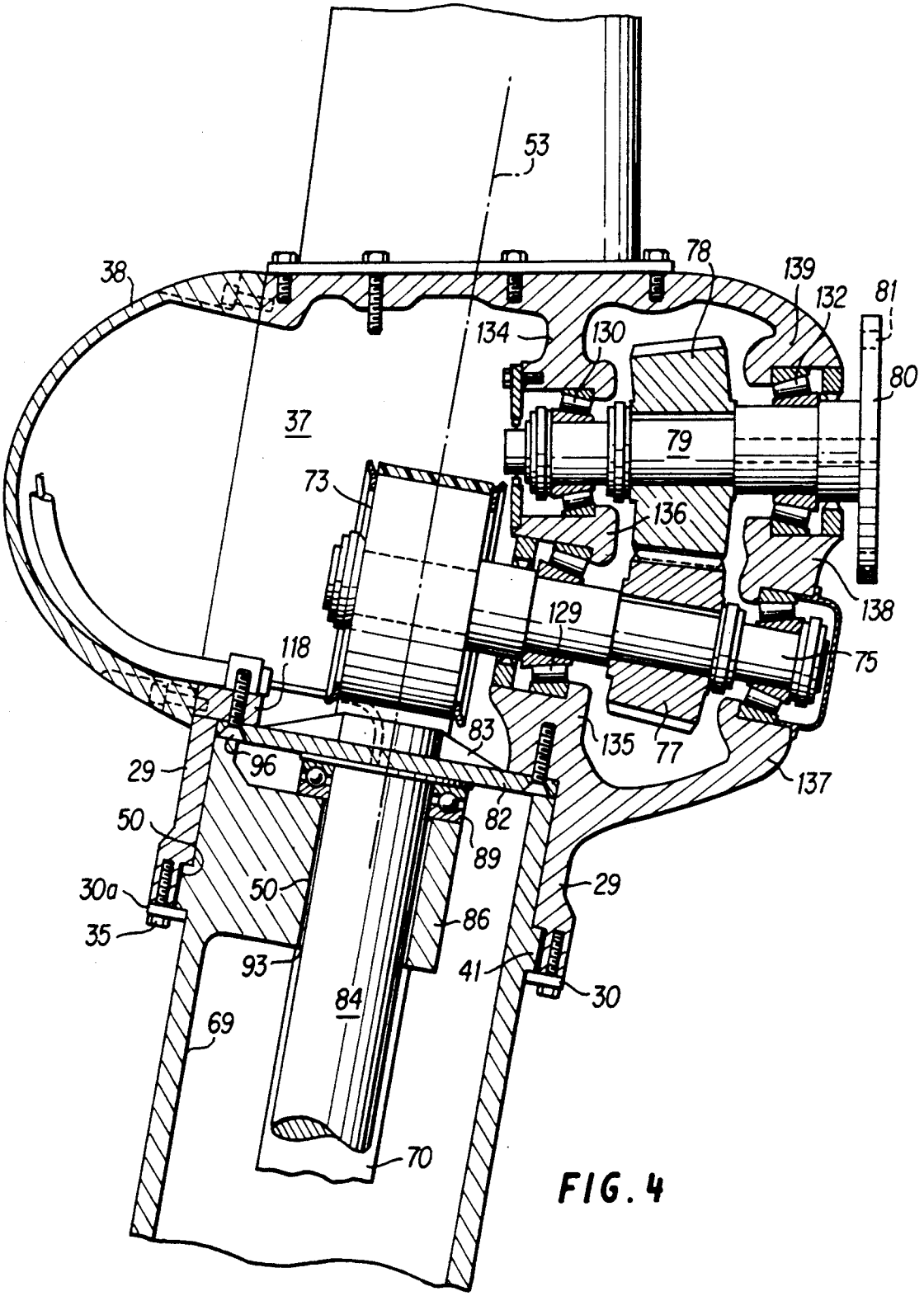
FIG. 4 is a fragmentary part elevation, part axial section in the same plane as the FIG. 3*a* section, on a further enlarged scale, of the upper portion of the support member, housing and gear train.

An endless belt 70, is trained around the pulley 67 and extends through the hollow interior 69 of the support member 40 and extends into the interior of housing 37 where it is trained around upper pulley 73 (FIG. 4). Endless belt 70 has a plurality of gear like teeth 74 on its inner surface. Pulleys 67 and 73 have corresponding gear teeth (not shown) for receiving teeth 74. The endless belt 70 is of the type marketed by GATES known as the Polychain GT belt made from KEVLAR®. Pulleys 67 and 73 are also of the type marketed by GATES and are also known as sprocket pulleys.

The bushing (not shown) in the tail shaft housing 62, which supports hollow shaft 63*a*, is of a type commonly used in Ford automatic transmissions. The bushing is not designed to withstand the lateral forces such as those induced by an endless belt and pulley configuration. The bearing housing 64 is such that lateral forces induced by torque delivered to the endless belt 70 are transmitted from the pulley 67 through brackets 144*a–e* and bolts 42 to the tail shaft housing 62. The tail shaft housing 62 is able to withstand the lateral forces induced by the motion of endless belt 70.

A belt tensioner (FIG. 3*b* and 3*c*) adjustably engages bracket 144*b* of bearing housing 64. A threaded member 71 of the belt tensioner coacts with a threaded bore 68 in a plate 76. The plate 76 is welded to the cross member 72. The threaded member 71 exerts a force upwards against a cross member 72 of the support structure 23. The threaded member 71 exerts a force downward against the bearing housing 64 through a rubber bumper 99 thus tensioning the endless belt 70. The flexible engine mounts 60 allow for pivotal movement of the engine 31 and transmission 61 about the mounts 60 making belt adjustments by the belt tensioner possible. The belt tensioner functions in tandem with adjustable rubber mount 98 which acts as the rear mount for the transmission 61. The rubber mount 98 is bolted to the underside of the tail shaft housing 62 by several bolts generally indicated by numeral 104. There are two bolts 104 one behind the other as shown in FIG. 3*c*. The bolts 104 also assist in securing the bearing housing 144 to the tail shaft housing 62. The rubber mount 98 is supported on its underside by a threaded member 103 which is adjusted by a nut 102. The nut 102 is supported by a bracket 106 which is bolted to the stringers 11. The rubber mount 98 allows the engine 31 and transmission 61 to undergo pivotal movement about the engine mounts 60, but restricts lateral movement of the transmission 61.

A brake mechanism is operably connected to the bearing housing 144. The brake mechanism, preferably a disk and caliper brake mechanism, includes a disk 149 bolted to the pulley 67. The caliper 66 of the brake mechanism is supported by a secondary bracket 150 that is welded to bracket 144*b*. The brake mechanism is controlled via a cable 151 to foot pedal 20. The cable 151 lies behind cable 105 in FIG. 2.

The support member 40 for the housing 37 is in the form of a generally cylindrical housing, having an interior surface 69. Support member 40 has upper and lower ends. The lower end of support member 40 is formed with a square base portion which is bolted to support structure 23 and aft deck 33 by bolts 107. The support member 40 is inclined from its lower end to its upper end toward the stern of the hull 13. The support member 40 is optimally inclined at an angle of 10° from the vertical. The central axis 53 (FIG. 4) of the support member 40 is also inclined 10°. The interior surface 69 of support member 40 is formed with two flanges 86 and 87 (FIGS. 3*a* and 4). Each flange is formed with a bore hole which is axially aligned with a central longitudinal axis 53, of the support member 40. The lower flange 87 has bore 92 and the upper flange 86 has bore 93.

Referring now to FIG. 4, the housing 37 is rotatably coupled to the support member 40 and the housing 37 pivots about central axis 53 which is generally longitudinally aligned with the center of the upper portion of the support member 40.

Figure 5A:
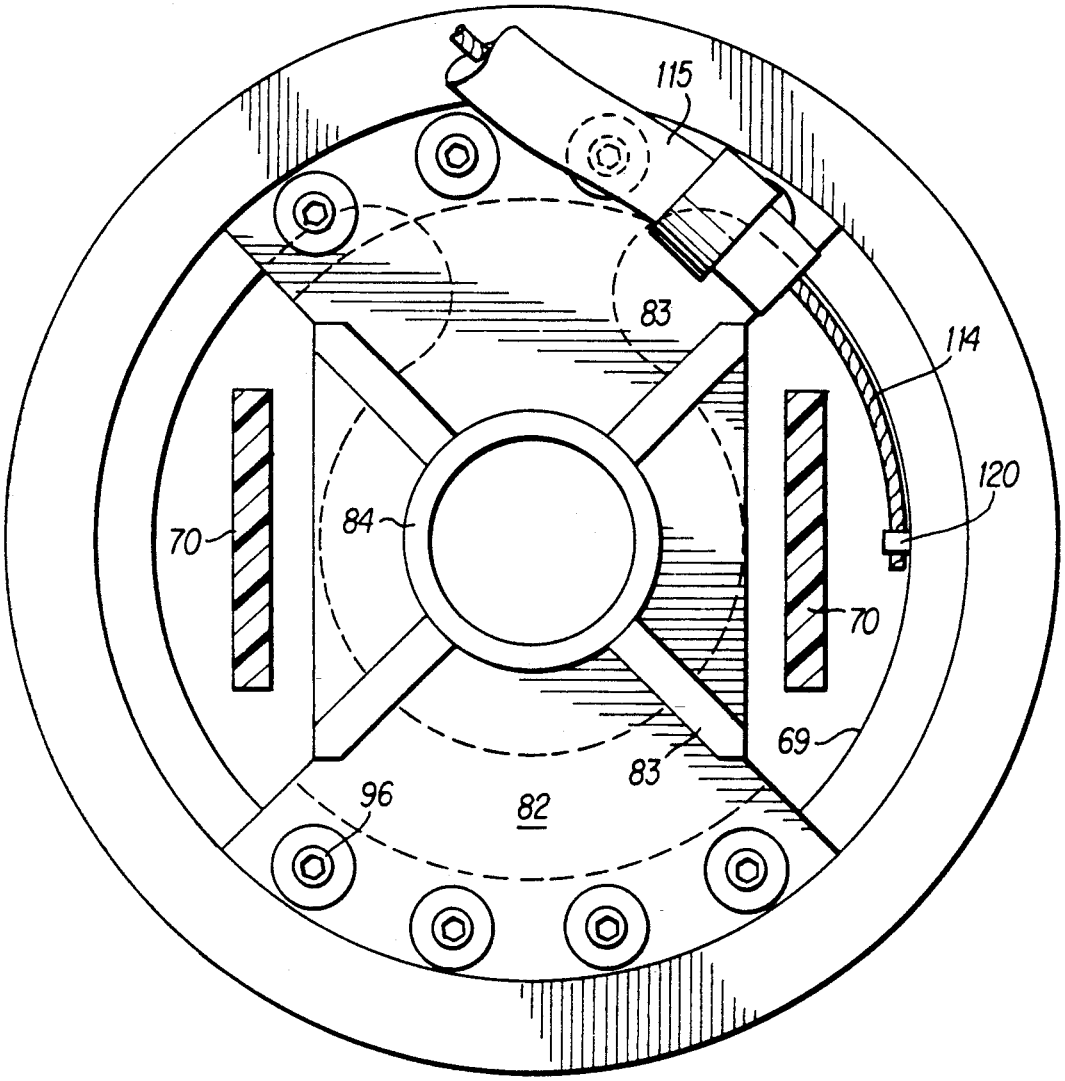
FIG. 5*a* is a section taken on the line V—V of FIG. 4, looking in the direction of the arrows, on an enlarged scale as compared to FIG. 4.
Figure 5B:
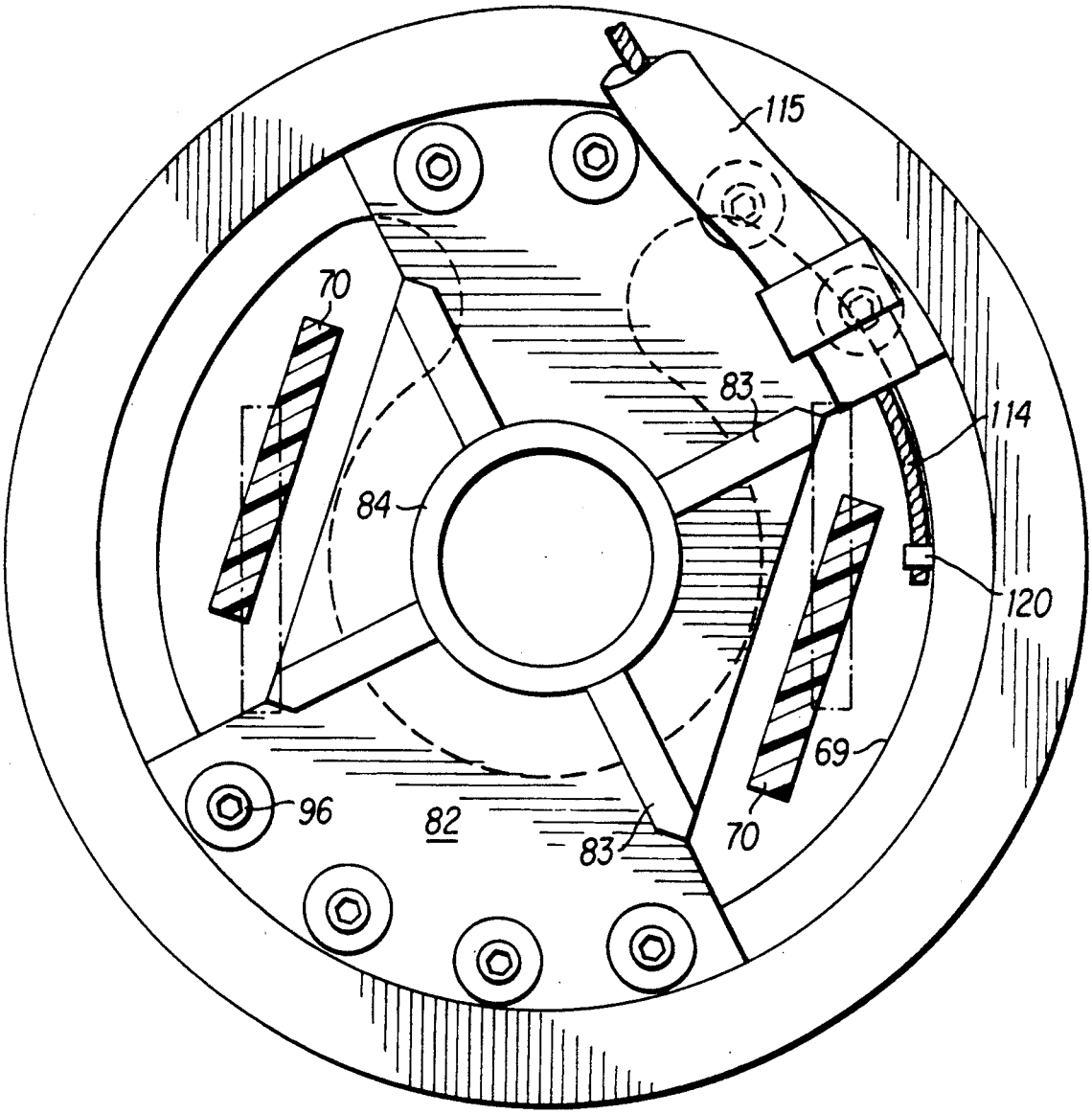
FIG. 5*b* is a section taken on the line V—V of FIG. 4 looking in the direction of the arrows, on the same scale as FIG. 5*a*, depicting the angular displacement of the bottom plate of the housing, the displacement of the cable and of the endless belt, with the centered position of the belt and plate, as depicted in FIG. 5*a*, shown in phantom.

The housing 37 includes a plate 82 secured by bolts 96 to the lower end 118 of the housing 37. The plate 82, depicted in FIGS. 5*a* and 5*b*, is welded to a steering shaft 84. Steering shaft 84 welded to plate 82, is reinforced by gussets 83. The steering shaft 84 is aligned with a central longitudinal axis 53 of the support member 40. The steering shaft 84 extends through bore holes 92 and 93. The steering shaft 84 and plate 82 are further supported by a bearing 89, the bearing 89 being supported by the flange 86.

The steering arm 91 (FIGS. 3*a*, 3*b* and 3*d*) is preferably connected to the lower end 95 of the steering shaft 84. Steering arm 91 and steering shaft 84 are cooperatively connected with a key way 90 (FIG. 3*d*) inserted in corresponding notches 88 formed in both the shaft 84 and the arm 91 as shown in FIG. 3*d*. A friction clamp 85 retains arm 91 on shaft 84. The pivotal movement of the steering arm 91 is hydraulically connected to the master cylinder 45 by hydraulic line 54 (FIG. 2).

FIGS. 5*a* and 5*b* depict the outline and shape of the flanges 86 and 87. The steering shaft 84 extends through the hollow interior 69 of support member 40 and further extends through flanges 86 and 87 as has been previously described. When the steering stick 24 is moved the motion is transmitted through the hydraulic master cylinder 45. The master cylinder 45 transmits the motion hydraulically to a slaved cylinder 48 through a hydraulic line 54 (FIG. 3*b*). A rod 51 connected to slaved double acting cylinder 48 and to arm 91 further transmits the motion from steering stick 24 to the arm 91. Movement of the arm 91 rotates the steering shaft 84, the housing 37 and the propeller 34 to direct thrust produced by the propeller 34 thus turning the boat 10 once it is in motion.

The shape of flanges 86 and 87 is important for allowing movement of the belt as the housing 37 rotates about the central axis 53. The belt 70 and the plate 82 are shown rotated about central axis in FIG. 5*b*. FIG. 5*b* further shows the position of plate 82 and the endless belt 70 in phantom in a centered position.

The housing 37 has a generally bullet shape. A cylindrical portion 29 extends downward from the lower surface of the housing 37 (FIGS. 3*a* and 4). The cylindrical portion 29 fits about the upper portion of the support member 40. The support member 40 has an upper peripheral boss 41 which operably engages the lower part of cylindrical portion 29 of housing 37. The housing 37 is rotatably retained about the boss 41 by retainer rings 30 and 30*a*. The half circle retainer rings 30 and 30*a* form a two piece ring which is bolted to the lower cylindrical portion 29 of housing 37 by bolts 35. A bearing tape 50, such as MULTIFIL™ 426 manufactured by GARLOCK and made of TEFLON® impregnated with brass filings, serves as a bearing between the lower cylindrical portion 29 of the housing 37 and the support member 40. The bearing tape 50 is further disposed between the boss 41 and the cylindrical portion 29 of the housing 37.

The housing 37 is fitted with a shaft 75, a first gear 77 connected to shaft 75 and a second gear 78 connected to the propeller output shaft 79. The housing 37 is formed with webbing 134, 135, 136, 137, 138 and 139. The shaft 75 is supported by the bearings 129 and 131. The bearing 129 is supported by the webbing 135 and the webbing 136. The bearing 131 is supported by the webbing 137 and the webbing 138. Similarly, the shaft 79 is supported by the bearings 130 and 132, the bearing 130 being supported by the webbing 134 and 136 and the bearing 132 being supported by the webbing 138 and 139. The shaft 79 is formed with a connecting plate 80 having bolt holes 81. The propeller 34 is fixed to plate 80 of shaft 79 by bolts (not shown) which extend through bolt holes 81 and corresponding holes (not shown) centrally located in propeller 34.

The gears 77 and 78 serve several purposes. One purpose is to make the direction of rotation of the propeller 34, oppose the direction of rotation of the crank shaft of the engine 31 when the transmission 61 is engaged to transmit power to the propeller 34 to produce forward motion of the boat 10. This counteracts any gyroscopic effects induced by either the engine 31 or the propeller 34, the rotation of each being in a direction opposite the other and thus tending to cancel out the gyroscopic effects of the other. Gears 77 and 78 also serve as a gear reduction unit reducing the rotational speed of the transmitted torque. Gear reduction is desirable in order to keep the rotational speed of the belt at a maximum velocity. The endless belt 70 transmits power more efficiently at high speeds.

Figure 7:
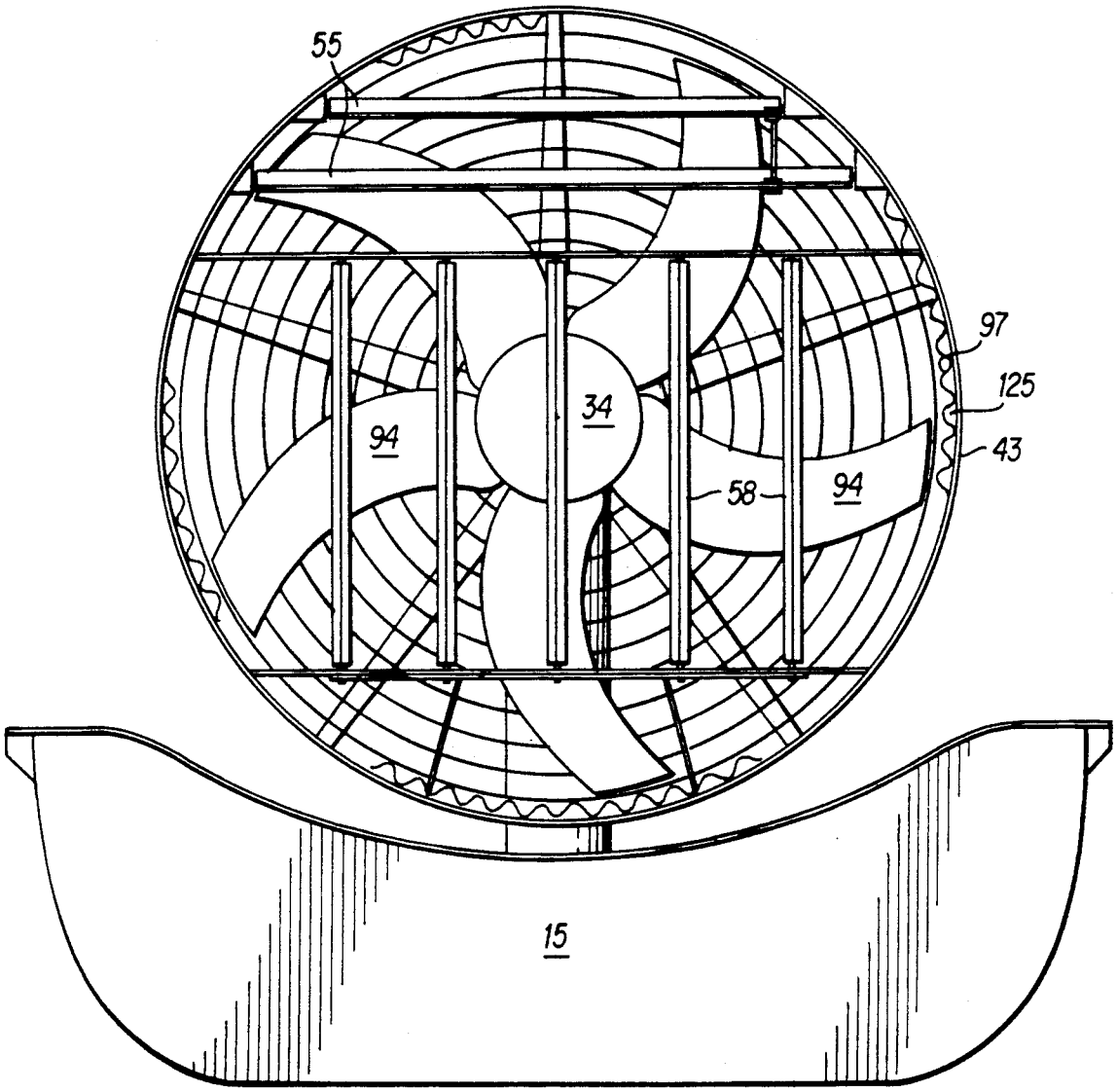
FIG. 7 is a rear elevation of the stern of the air boat.

The propeller 34 bolted to plate 80 has an odd number of blades for reducing vibration, and more preferably has five swept-back blades 94 (FIG. 7). The swept-back contour of the blade 94 reduces blade noise at high rates of rotation. Swept back propeller blades are further discussed in NASA publication NOISE-CON 77, "Some Advances In Design Techniques For Low Noise Operation Of Propellers And Fans", by Richard E. Hayden.

A shroud 43 (FIGS. 1, 3*a*, 6 and 7) is shown generally encircling the propeller 34. The shroud 43 is coupled to the housing 37 by hollow spokes 49. Each hollow spokes 49 has an open end connected to the housing 37. A plurality of cylindrical rings 46 are concentric with the propeller output shaft 79 and are fixed to spokes 49 on an inlet side 47 (FIG. 2) of the shroud 43.

The shroud 43 preferably includes a pair of air foils 55 mounted to the downstream or slipstream side 56 of the shroud 43 along a horizontal axis. The air foils 55 are pivotably coupled to each other via a rod linkage 100 which is coupled to a cable 105 (FIG. 3*a*). The cable 105 is disposed in one of the hollow spokes 49, and extends through the housing 37, the propeller support member 40 and under the engine cover 27 to the foot pedal 21.

Figure 6:
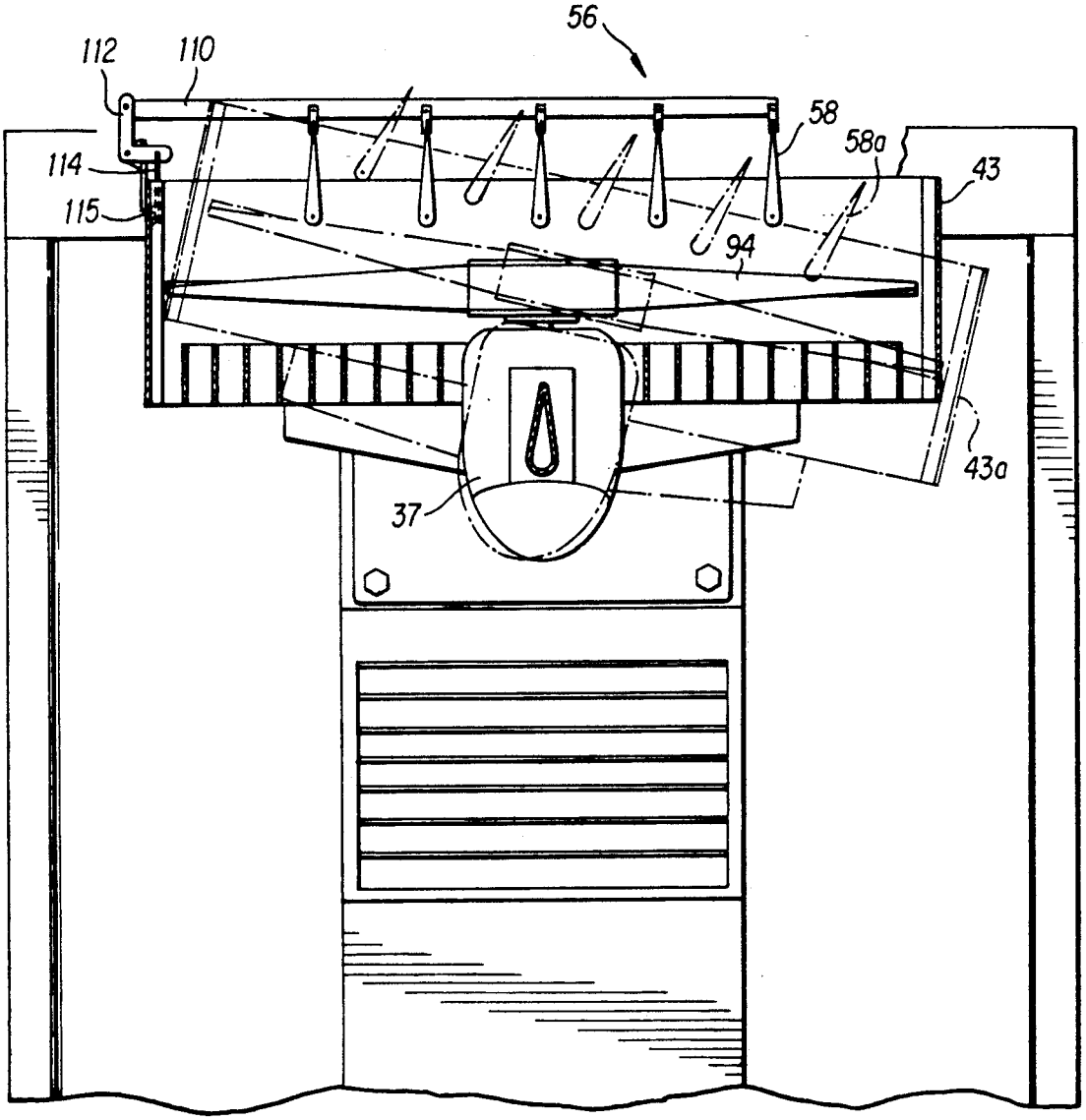
FIG. 6 is a fragmentary top plan view of the stern of the air boat, on the same scale as FIG. 3*a*, depicting in phantom the angular displacement in a clockwise direction of both the shroud and rudders.

The shroud 43 also preferably includes a plurality of rudders 58 mounted along a plurality of generally parallel vertical axes to the slipstream side 56 of shroud 43. Referring now to FIG. 6, rudders 58 are coupled to the slipstream side 56 of the shroud 43 and pivotal movement of the rudders 58 is controlled by a rod linkage 110 which is coupled to a pivot arm 112. The pivot arm 112 is connected to a first end of cable 114. The cable 114 is disposed in a sleeve 115. The sleeve 115 extends through one of the hollow spokes 49 into the housing 37. The sleeve 115 is attached to the housing 37 (FIG. 5*a*). The second end of cable 114 is attached to the interior surface 69 of the support member 40 at a point 120. The cable 114 serves to slave the movement of the rudders 58 to the movement of the power housing 37.

FIG. 6 further depicts the housing 37 and shroud 43 in a centered position, and having angularly displacement (in phantom) about the central longitudinal axis 53 with displacement of the slaved rudders 58 (also in phantom). Numeral reference 43*a* (in phantom) indicates the shroud with angular displacement and numeral reference 58*a* shows rudders 58 with angular displacement. The rudders, being slaved to the movement of the housing 37, move simultaneously with the housing 37. The housing 37 moves in an approximate turning arc path of 15° toward the starboard side 18 and 15° toward the port side 17 with respect to the centered position shown in FIG. 6. The rudders 58 rotate with respect to the housing 37 by a ratio that is defined as follows:

Angular displacement of the housing 37 is measured with respect to the stern 15 of the hull 13.

Angular displacement of the rudders 58 is measured with respect to the stern 15 of the hull 13.

The ratio is hereinafter referred to as an angular displacement ratio:

$$ADR = \frac{\text{Drud}}{D_h}$$

The angular displacement ratio ADR is varies depending upon the size of the boat and the turning radius required, and therefore, this ratio can be anywhere from 1:1 to approximately 4:1. For instance, one boat may require a ratio of 4:1 for effective turning and another boat may require only a 1:1 ratio.

To better understand the displacement ratio, the following example is provided. If the angular displacement ratio is 2:1, when the housing 37 is turned 1° to the starboard side 18 of the boat 10, the rudders would rotate 2° to the starboard side 18 of the boat 10 with respect to the stern 15.

An advantage in using both a housing 37 coupled with pivoting rudders 58 is that only a portion of air thrust produced by the propeller 34 is actually diverted by the rudders 58. Diverting air thrust for effecting a turn is inefficient in that a portion of the thrust is lost due to friction between the air and the rudders. Also, rudders in the slipstream of the propeller have the inherent characteristic of being self-centering. Therefore, by using both a pivoting housing 37 and pivoting rudders 58, air thrust is more efficiently used, while still maintaining a certain degree of the self-centering characteristics of slipstream rudders. FIG. 5*b* depicts the plate 82 and the steering shaft 84 angularly displaced about the axis 53. The angular displacement of the shaft 84 and the plate 82, approximately corresponds with the displacement of the shroud 43 and housing 37 depicted in FIG. 6. FIG. 5*b* further shows the displacement of the cable 114 in response to the displacement of the plate 82 about the axis 53.

Referring now to FIG. 7, a corrugated, multi-apertured noise reducing material 97 is used to line the inner surface of the shroud 43. The curved surface of the corrugated material helps to disperse the shock waves generated by the blades 94 of propeller 34, thus reducing noise. Further, the multi-apertured surface of the corrugated material 97 allows a portion of the shock waves to penetrate it, where the waves can be absorbed by a material 125 such as fiber glass which may be inserted in between the corrugated material 97 and the shroud 43.

Operation of the Preferred Embodiment

In the preferred embodiment of the present invention, the air boat is controlled from the operator's chair 16. An operator (not shown) seated in the operator's chair 16 has foot pedals 19, 20 and 21 and steering stick 24 adjacent the operator's chair 16 for controlling the boat. It should be noted however, that the operator's seat need not be centrally positioned as it is shown in FIG. 1 but may be lower and/or positioned on either side of the boat with, for instance, an automotive type steering wheel for steering the boat or a pilot's stick (or "joystick") similar to those used to control small aircraft.

The engine throttle is preferably, controlled by a foot pedal 19 which is coupled to the engine 31 by a cable or push-pull rod linkage (not shown) such as is known in the art. Torque produced by the engine 31 is transmitted through the transmission 61, to the propeller 34 via bearing housing 64, pulleys 67 and 73 endless belt 70, and further transmitted through shaft 75, gears 77 and 78 and shaft 79 to propeller 34.

A second foot pedal 20 is preferably, operably connected to the brake mechanism 66 by cable 151, but could also be connected via a push-pull rod linkage or hydraulic system. The brake mechanism is used for reducing the speed of the propeller 34. It should further be noted that the brake mechanism may alternately be located within the housing 37 and coupled to either shaft 75 or propeller shaft 79.

With the engine at partial or full throttle, and the coupling unit 61 engaging the propeller 34 such that the propeller 34 produces air thrust, an operator seated in the operator's chair 16 steers the boat 10 by manipulating the steering stick 24. Pulling the steering stick 24 back towards the stern 15 of the boat 10 turns the housing 37, and hence propeller 34, to the port side 17 of the stern 15 effecting a turn to port. Pushing the steering stick 24 toward the bow 14 of the boat 10 turns the housing 37, and hence the propeller 34, to the starboard side 18 of the stern 15 effecting a turn to starboard. Putting the stick 24 back to a central position such that the propeller shaft 79 is aligned with the longitudinal center line of the boat 10, would return the housing 37, the rudders 58 and hence the propeller 34 to a central or neutral position as depicted in FIGS. 1, 2, 3*a*, 6 and 7.

The shroud 43, the rings 46 and the brake mechanism further work in combination with each other as a means for reducing the speed of the boat. The brake mechanism is capable of stopping the rotation of the propeller 34. The propeller 34, having five blades 94 each with a large surface area, in combination with the unidirectional flow of air from the rings 46 into the shroud 43, acts as an air brake when the brake mechanism reduces the rotational speed of the propeller 34.

Braking drag from the propeller is created while the propeller is still rotating but is being slowed by the brake. Airplane and helicopter pilots commonly use "flying" resistance for manipulating aircraft. "Flying" resistance is drag induced by a propeller whose rotational speed is being reduced relative to the speed of the craft powering it. When the propeller is finally stopped, the "flying" resistance is lost. "Flying" resistance is used by helicopter pilots when a helicopter rotor is in an "Auto Rotation" or "no power" decent to control the decent of the helicopter.

Alternately, if the propeller 34 is stopped by the brake mechanism, the transmission 61 can be selectively engaged to produce reverse rotational direction torque producing a reverse thrust from the propeller 34 assisting in a slowing down or stopping maneuver.

The third foot pedal 21 is coupled via a cable to the air foils 55 attached to the upper portion of the shroud 43. This foot control pedal 21 when depressed causes the air foils 55 to angle downward diverting air from the slipstream side 56 of the propeller 34 causing the rear of the boat to lift, assisting in efforts to get the boat 10 into a hydroplaning position.

While the boat has forward motion and is hydroplaning, the air foils serve as a means for adjusting the position of the bow relative to the water. For instance, the air foils can serve as a "flying trim" (a term commonly used by aircraft pilots) for either having the bow move up or the bow move down relative to the water surface. This feature provides a means for keeping the boat level in the event of uneven weight distribution in the boat.

The position of the engine 31 and the transmission 61, is such that the center of gravity is well forward the stern and close to the water line of the hull.

The cylindrical concentric rings 46 direct incoming air, effecting a generally unidirectional flow into the shroud 43. The unidirectional flow of air tends to increase the efficiency of the propeller 34 and upon sudden power loss at high speeds, the rings 46 and the shroud 43 provide a means for directing air flow and make directional stability possible, preventing total loss of control of the boat 10. The cylindrical concentric rings 46 further protect passengers from the dangers associated with a rotating propeller.

The 10° angle of inclination of the support member 40 and of the shaft 84 is such that the central axis 53 of the shaft, if extended, would penetrate the shroud 43. The inclination of the central axis 53 allows the length of propeller shaft 79 to be a minimum, hence making the plane of rotation of the propeller 34 as close to the central axis 53 as possible. By minimizing the distance between the axis 53 and the plane of rotation of the propeller 34, the lateral movement of the shroud 43 and of the propeller 34 is minimized with respect to the aft end of the boat 10. The clearance between the shroud 43 and the rear of the boat is therefore minimized.

The apparatus described herein is not limited solely to use in an air boat, but may also be adapted for use in apparatus such as a snow or ice sleigh, or an automobile.

Further, the foot pedals 19, 20 and 21 and steering stick 24 may be coupled to elements within the structure of the boat by means other than the cable disclosed herein, such as push rods, hydraulic couplings, or electromechanical devices.

The engine 31 and coupling unit 61 are preferably of the type used in automotive applications, such as a Ford 305 cubic inch displacement V-8 engine and a Ford C-4 automatic transmission. The engine and transmission mentioned above are stock items, for which parts and accessories are generally readily available at reasonable prices. The present air boat, therefore, may be serviced and repaired by the owner or operator without the major expense associated with the use of aircraft engines disclosed in the prior art, and may be operated in both forward and reverse directions.

The present invention provides a more inherently stable air boat due to the usage of the cylindrical concentric rings and a shroud in proximity to the propeller, and due to having the engine placed well below the propeller's axis of rotation, thus lowering the center of gravity of the boat as compared to air boats known in the prior art.

The engine is positioned forward the stern of the boat by a length that corresponds to the length of the transmission. The placement of the engine forward from the stern of the boat, moves the center of gravity of the entire boat more forward than in previously manufactured air boats. As well, the center of gravity of the boat is lower than the boats described in the prior art due to the placement of the engine which is secured directly to the bottom of the hull The present air boat is safer to operate at all speeds of operation. The air boat is also more stable and controllable in the event of power loss at high speeds due to the steering capabilities provided by the cylindrical concentric rings and shroud.

The present air boat is also considerably more quiet than prior art boats, allowing for increased enjoyment and comfort due to the use of a propeller blade with a swept back shape and the use of noise reduction material in the shroud. In prior art boats which use air craft engines, the operator and passengers must typically wear ear muffs in order to muffle the tremendous noise from both the engine and propeller. Passengers in the present air boat need not wear noise suppressing devices.

Although the present invention has been described with reference to various preferred embodiments, the invention is not limited to the detail set forth above. Other substitutions and modifications which may occur to those of ordinary skill in the art are intended to follow within the scope and spirit of the invention as set forth in the appended claims.

What is claimed is:

1. A propeller-driven air boat having a hull, and comprising;

a source of power disposed in said hull;

an air propeller for driving the boat, operatively connected to said source of power for rotating said propeller;

means for mounting said propeller adjacent the stern of the boat, said propeller mounting means being mounted for angular movement about a generally upright axis that is disposed in a plane that passes through the fore-and-aft centerline of said hull;

rudder means, mounted to said propeller mounting means such that said rudder means moves with said propeller mounting means, for controlling the direction of movement of the boat; and means for rotating said propeller mounting means about said generally upright axis to turn said propeller for controlling the direction of movement of the boat.

2. The air boat of claim 1, wherein said upright axis is inclined from its lower end to its upper end in a direction toward the stern of the boat.

3. The air boat of claim 1, further comprising:

a generally cylindrical shroud that is disposed about said propeller and that is generally concentric with the axis of rotation of said propeller, and a plurality of concentric rings disposed within said shroud adjacent to, but forward of, said propeller, said rings not only being concentric with each other but also generally concentric with said shroud and with the axis of rotation of said propeller.

4. The air boat of claim 1, further comprising;

a generally cylindrical shroud disposed about said propeller and concentric with the axis of rotation of said propeller; and at least one airfoil disposed at least partly within said shroud, said airfoil being mounted for pivotal movement about a generally horizontal axis, for adjustably imparting lift to said boat during forward motion of the boat.

5. The air boat of claim 1, further comprising a generally cylindrical shroud disposed about said propeller concentrically with the axis of rotation of said propeller; wherein said rudder means is disposed adjacent said propeller, at least partly within said shroud, said rudder means being mounted for pivotal movement about a generally upright axis, as one means for steering the boat.

6. The air boat of claim 1, further comprising a generally cylindrical shroud that is disposed about said propeller and that is generally concentric with the axis of rotation of said propeller; and a noise reducing material disposed on the inner surface of said shroud.

7. The air boat of claim 1 wherein said source of power comprises an automobile engine and an automotive transmission operatively mounted on said engine.

8. A propeller-driven air boat having a hull, and comprising:

a source of power disposed in said hull;

a propeller for driving said boat, operatively connected to said source of power to rotate said propeller;

means for mounting said propeller adjacent the stern of the boat, said propeller mounting means being mounted for angular movement about a generally upright axis that is disposed in a plane that passed through the fore-and-aft centerline of said hull, said axis being inclined from its lower end to its upper end in a direction toward the stern of the boat;

means for rotating said propeller mounting means about said generally upright axis to turn said propeller for controlling the direction of movement of the boat;

a generally cylindrical shroud that is disposed about said propeller and that is generally concentric with the axis of rotation of said propeller;

a plurality of concentric rings within said shroud disposed adjacent to but forward of said propeller, said rings not only being concentric with each other but also generally concentric with said shroud and with the axis of rotation of said propeller; and at last one rudder means disposed adjacent said propeller for controlling the direction of movement of the boat, said rudder means being mounted to said shroud for pivotal movement about a generally upright axis.

9. A propulsion drive train for a propeller-driven airboat having a hull, comprising:

a drive shaft;

a source of power disposed in said hull in operative fashion to transmit power to said drive shaft;

a propeller for driving the boat, operatively, connected to said source of power for rotating said propeller;

means for mounting said propeller adjacent the stern of the boat, said propeller mounting means being mounted for rotational movement about a generally upright axis that is disposed in a plane that passes through the fore-and-aft centerline of said hull, said axis being inclined from its lower region to its upper region in a direction toward the stern of said hull;

means for rotating said propeller mounting means about a generally upright axis to run said propeller for controlling the direction of movement of the boat;

a generally cylindrical shroud disposed about said propeller, concentrically with the axis of rotation of said propeller, said shroud being mounted for angular movement upon rotational movement of said propeller mounting means; and at least one airfoil disposed at least partly within said shroud, said air foil being mounted for pivotal movement about a generally horizontal axis, for use during operation of said propeller to provide lift to said hull.

10. a propulsion drive train for a propeller-driven airboat having a hull, comprising:

a drive shaft;

a source of power disposed in said hull in operative fashion to transmit power to said drive shaft;

a propeller operatively connected to said drive shaft for driving said boat;

means for mounting said propeller adjacent the stern of the boat, said propeller mounting means being mounted for rational movement about a generally upright axis that is disposed in a plane that passes through the fore-and-aft centerline of said hull, said axis being inclined from its lower region to its upper region in a direction toward the stern of said hull;

means for rotating said propeller mounting means about a generally upright axis to turn said propeller for controlling the direction of movement of the boat;

a generally cylindrical shroud disposed about said propeller, concentrically with the axis of rotation of said propeller, said shroud being mounted for angular movement upon rotational movement of said propeller mounting means; and a noise reducing material disposed on the inner surface of said shroud.

11. A propulsion drive train for a propeller-driven airboat having a hull, comprising:

a drive shaft;

a source of power disposed in said hull in operative fashion to transmit power to said drive shaft to drive it;

an air propeller for driving said boat, operatively connected to said drive shaft for rotating said propeller;

means for mounting said propeller adjacent the stern of the boat, said propeller mounting means being mounted for rotational movement about a generally upright axis that is disposed in a plane that passes through the fore-and-aft centerline of said hull, said upright axis being inclined with respect to said hull from its lower region to its upper region in a direction toward the stern of said hull;

means for rotating said propeller mounting means about said generally upright axis to turn said propeller for controlling the direction of movement of the boat; and a generally cylindrical shroud disposed about said propeller, concentrically with the axis of rotation of said propeller, said shroud being mounted for angular movement upon rotational movement of said propeller mounting means, wherein said upright axis, if extended upwardly, intersects the shroud.

12. A propulsion drive train for a propeller-driven airboat having a hull, comprising:

a drive shaft;

a source of power disposed in said hull in operative fashion to transmit power to said drive shaft to drive it;

a propeller for driving said boat, operatively connected to said drive shaft for rotating said propeller;

means for mounting said propeller adjacent the stern of the boat, said propeller mounting means being mounted for rotational movement about a generally upright axis that is disposed in a plane that passes through the fore-and-aft centerline of said hull, said upright axis being inclined with respect to said hull from its lower region to its upper region in a direction toward the stern of said hull;

means for rotating said propeller mounting means about said generally upright axis to turn said propeller for controlling the direction of movement of the boat, a generally cylindrical shroud disposed about said propeller, concentrically with the axis of rotation of said propeller, said shroud being mounted for angular movement upon rotational movement of said propeller mounting means; and a plurality of concentric rings disposed within said shroud adjacent said propeller, each of said rings being concentric with respect to each other and said shroud.

13. The drive train of claim 1, further comprising:

a plurality of vertically spaced airfoils mounted to said shroud, substantially in parallel with each other, for pivotal movement about respective generally horizontal axes, to permit adjustment of the airfoils in unison during forward movement of the boat, thereby providing lift to the hull.

14. The drive train of claim 11, further comprising:

a plurality of rudder blades mounted to said shroud adjacent said propeller, said rudder blading mounted for limited pivotal movement each about a generally vertical axis, in unison with the other rudder blades, to assist in steering the boat during forward movement.

15. The drive train of claim 14, wherein said rudder blades are mounted to said shroud in slave fashion for pivotal movement about their respective axes of rotation in response to rotational movement of said propeller mounting means.

16. The drive train of claim 13, further comprising a plurality of rudder blades mounted to said shroud adjacent said propeller, said rudder blades being mounted for limited pivotal movement each about a generally vertical axis, in unison with the other rudder blades, to assist in steering the boat during forward movement.

17. The drive train of claim 16, wherein said rudder blades are mounted in slave fashion for pivotal movement about their respective axes of rotation in response to rotational movement of said propeller mounting means.

18. The drive train of claim 17, wherein the pivotal movement of said rudder blades is mechanically directly controlled by the rotational movement of said propeller mounting means by an angular displacement ratio of which is defined as the angular displacement of the rudders measured with respect to the hull of the boat divided by the angular displacement of the propeller mounting means also measured with respect to the hull of the boat, said ratio being from about 1:1 to about 4:1.

19. The drive train of claim 11 wherein said source of power comprises an automobile engine and an automobile transmission operatively mounted on said engine.

20. The drive train of claim 19, wherein said automobile transmission may be operated to interconnect said automotive engine and said drive shaft for forward motion and for reverse motion of the boat, and in a neutral position.

21. The drive train of claim 11 further comprising braking means for reducing the rate of rotation of the propeller when the propeller is rotating.

22. A propulsion drive train for a propeller-driven airboat having a hull, comprising:

a drive shaft;

an automotive engine secured within said hull;

an automatic automotive transmission operatively secured to said engine within said hull, in operative fashion for transmitting power to said drive shaft;

a propeller for driving said boat, operatively connected to said drive shaft for rotating said propelling;

means for mounting said propeller adjacent the stern of the boat, said propeller mounting means being mounted for rotational movement about a generally upright axis that is disposed in a plane that passes through the fore-and-aft centerline of said hull, said axis being inclined from a lower region to an upper region toward the stern of said hull;

means for rotating said propeller mounting means about said generally upright axis to turn said propeller in order to control the direction of movement of the boat;

a generally cylindrical shroud disposed about said propeller concentrically with the axis of rotation of the propeller;

at least one ring disposed within said shroud adjacent to said propeller, said ring being concentric with the axis of rotation of said propeller;

at least one airfoil mounted at least partly within said shroud for pivotal movement about a generally horizontal axis, to permit adjustment of the airfoil to provide lift during the forward motion of the boat, said airfoil being disposed above the axis of rotation of said propeller; and at least one rudder disposed at least partly within said shroud and below said airfoil, said rudder being mounted for limited pivotal movement about a generally upright axis, to assist in steering the boat during its forward movement.

23. The drive train of claim 22, said upright axis is inclined to the vertical at an angle of from about 1° to about 15°.

24. The drive train of claim 22 further comprising a noise reducing material fixed to the inner surface of said shroud.

25. The drive train of claim 22 wherein said propeller comprises a plurality of blades each having a swept back leading edge.

26. The drive train of claim 25 wherein said propeller has five blades.

27. A propulsion drive train for propeller-driven airboat having a hull, comprising:

a drive shaft;

an automotive engine secured within said hull;

an automatic automotive transmission operatively secured to said engine within said hull, in operative fashion for transmitting power to said drive shaft to drive it;

a propeller for driving said boat, operatively connected to said drive shaft for rotating said propeller;

means for mounting said propeller adjacent the stern of the boat, said propeller mounting means being mounted for rotational movement about a generally upright axis that is disposed in a plane that passes through the fore-and-aft centerline of said hull, said axis being inclined from a lower region to an upper region toward the stern of said hull;

means for rotating said propeller mounting means about said generally upright axis to turn said propeller in order to control the direction of movement of the boat;

a generally cylindrical shroud disposed about said propeller concentrically with the axis of rotation of the propeller;

a plurality of concentric rings disposed adjacent to said propeller, within said shroud, said rings not only being concentric with each other but also generally concentric with said shroud and with the axis of rotation of said propeller; and a plurality of rudder blades mounted to said shroud adjacent said propeller, said rudder blades being mounted for limited pivotal movement each about a generally vertical axis, in unison with the other rudder blades, to assist in steering the boat during forward movement;

wherein said upright axis intersects said shroud.

28. A steering apparatus for a propeller-driven airboat having a hull, comprising:

an air propeller mounted adjacent the stern of said hull for rotation about a generally horizontal axis, to impel movement of the boat;

means for driving and thereby rotating said propeller;

a generally cylindrical shroud disposed about said propeller concentrically with the axis of rotation of said propeller; and rudder means for controlling the direction of movement of the boat mounted on said shroud, such that said rudder means is disposed in the slipstream of said propeller during forward motion of said boat;

wherein said shroud and said propeller are mounted to said hull for limited angular movement as a unit about a generally vertical axis.

29. The steering apparatus of claim 28 further comprising at least one generally cylindrical ring mounted adjacent the forward face of said shroud and at least partly within said shroud, concentric with the axis of rotation of said propeller.

30. The steering apparatus of claim 28 further comprising a plurality of generally cylindrical rings of different diameters, that are disposed adjacent the forward face of said shroud, concentrically with the axis of rotation of said propeller and in spaced relation to each other, to channel the flow of air toward said propeller during forward motion of the boat.

31. The steering apparatus of claim 28, wherein said rudder means comprises a plurality of rudder blades that are mounted for limited pivotal movement in unison respectively about parallel, generally vertical axes of rotation.

32. The steering apparatus of claim 31, wherein the limited pivotal movement of said rudder blades is slaved to the limited angular movement of said shroud and said propeller.

33. The steering apparatus of claim 32, wherein the limited pivotal movement of said rudder blades has a ratio to the angular movement of said shroud and said propeller unit of from about 1:1 to 4:1.

34. The steering apparatus of claim 28 wherein said propeller has five blades, each having a swept back leading edge.

35. The steering apparatus of claim 28 further comprising at least one airfoil mounted in said shroud and disposed at least partly within said shroud, said airfoil being disposed adjacent the aft edge of the propeller and in the slipstream region of the propeller during the forward motion of the boat, said airfoil being mounted for limited angular movement about a generally horizontal axis, for adjustably imparting lift to said boat.

36. The steering apparatus of claim 35 further comprising a plurality of said airfoils, disposed in parallel at different elevations within said slipstream region, said airfoils being mounted for limited angular movement as a unit about their individual respective axes of rotation.

37. A steering apparatus for a propeller-driven airboat having a hull, comprising:

a propeller mounted adjacent the stern of said hull for rotation about a generally horizontal axis, to impart movement to the boat;

means for driving said propeller to rotate it, a generally cylindrical shroud disposed about said propeller concentrically with the axis of rotation of said propeller;

a plurality of generally cylindrical rings of different respective diameters disposed adjacent the fore face of said shroud and concentric of each other and of said shroud and also of the axis of rotation of said propeller; and a plurality of rudder blades that are mounted to said shroud and disposed to be in the slipstream of said propeller during forward motion of said boat, said blades being mounted for limited rotary movement in unison about parallel, generally vertical axes of rotation respectively;

wherein said shroud and said propeller are mounted for limited angular movement as a unit about a generally vertical axis.

38. The steering apparatus of claim 37 wherein said propeller has five blades, each having a swept back leading edge.

39. The steering apparatus of claim 37 further comprising a plurality of airfoils mounted within said shroud, adjacent the aft side of said propeller, said airfoils being mounted for limited rotary movement in unison about parallel, generally horizontal axes of rotation respectively, said airfoils being spaced from each other at different elevations relative to the hull of the boat.

40. The steering apparatus of claim 37, wherein said propeller driving means comprises an automobile engine and an automotive automatic transmission having an output shaft operatively mounted on said engine.

41. The steering apparatus of claim 40 wherein said propeller driving means further comprises an endless belt and pulley system for transmitting power between the output shaft of said automatic transmission and said propeller.

42. The steering apparatus of claim 41, wherein said propeller driving means further comprises a pulley support housing operably mounted on said automotive automatic transmission for transmitting power from said output shaft of said automatic transmission to said endless belt.

43. A propulsion drive train for an air thrust propeller driven boat having a hull, said propulsion drive train comprising:

an engine mounted to the hull, said engine having an output shaft;

a support member coupled to the hull;

a housing mounted on said support member, said housing being mounted for limited angular movement about a generally upright axis disposed in a plane that passes through the fore-and-aft centerline of said hull;

an air propeller having at least one blade, said propeller being rotatably mounted on a propeller shaft, said propeller shaft being supported by and housed in said housing;

means for rotating said housing about said upright axis to turn said propeller for controlling the direction of movement of the boat;

at least one rudder coupled to the housing at a location aft of said propeller such that said rudder is in the slipstream region of said propeller, during forward motion of the boat, said rudder being mounted for limited pivotal movement about a generally upright axis, to assist in steering the boat during its forward motion;

means for pivoting said rudder; and means for transmitting power from said engine to said propeller shaft to rotate said propeller.

44. The propulsion drive train of claim 43, wherein pivotal movement of said rudder is slaved to rotational movement of said housing.

45. The propulsion drive train of claim 44, wherein pivotal movement of said rudder is related to rotational movement of said housing by an angular displacement ratio, said angular displacement ratio being from about 1:1 to about 4:1.

46. The propulsion drive train of claim 43, further comprising:

a plurality of cylindrical rings fixed to said housing on the forward side of said propeller concentric with said propeller shaft.

47. The propulsion drive train of claim 43, wherein said support member further comprises:

a cylindrical tube-like support member having a bore, said support member having lower and upper ends, said lower end being mounted to the hull, said housing being mounted for limited rotational movement on said upper end;

wherein said means for transmitting power from said engine to said propeller extends through the bore of said support member.

48. The propulsion drive train of claim 47, wherein said means for transmitting power form said engine to said propeller comprises gear means disposed within said housing for reducing the output speed of said power transmitting means, and said gear means causing said propeller to rotate in a direction opposite the direction of rotation of the output shaft of said engine.

49. The propulsion drive train of claim 47 wherein said means for controlling angular movement of said housing comprises a steering shaft attached to a lower portion of said housing, said steering shaft extending through the bore of said support member.

50. The propulsion drive train of claim 49 wherein said power transmitting means comprises an endless belt and pulley system, said belt traversing a path which encircles said steering shaft.

51. The propulsion drive train of claim 50, further comprising an automotive-type automatic transmission, having a shaft, operably mounted to said engine, and operably coupled to said power transmitting means.

52. The propulsion drive train of claim 51, further comprising;

a pulley support housing mounted to said transmission;

a pulley rotatably mounted on said pulley support housing and operably connected to the shaft of said transmission, said endless belt being trained about said pulley; and a belt tensioning mechanism for adjusting the tension of said endless belt.

53. The propulsion drive train of claim 43, further comprising a generally cylindrical shroud disposed about said propeller concentric with said propeller output shaft, said shroud being secured to said housing.

54. The propulsion drive train of claim 53, wherein said rudder is disposed at least partly within said shroud.

55. The propulsion drive train of claim 53, wherein said shroud includes a noise reducing material disposed over the inner surface of the shroud.

56. The propulsion drive train of claim 53, further comprising at least one airfoil disposed at least partly within said shroud in the slipstream region of said propeller when the boat is moving forward, said airfoil being mounted for pivotal movement about a generally horizontal axis, to permit adjustment of the airfoil to provide lift during forward motion of the boat, said airfoil being disposed above the axis of rotation of said propeller.

57. The propulsion drive train of claim 43, wherein said support member is inclined from its lower end to its upper end in a direction toward the stern of the boat at an angle of from about one degree to about 15 degrees.

58. The propulsion drive train of claim 43, further comprising an automotive-type automatic transmission operably mounted to said engine, and operably coupled to said power transmitting means.

59. The propulsion drive train of claim 43, wherein said propeller further comprises a plurality of blades each having a swept back leading edge.

60. The propulsion drive train of claim 59, wherein said propeller has five blades.

61. The propulsion drive train of claim 43, wherein said support member and said upright axis of rotation are inclined from a lower end to an upper end of said support member towards the rear of the hull.

62. A steering apparatus for an air thrust propeller driven boat having a hull, an engine and a rotating propeller, said propeller being operably connected to said engine, said steering apparatus comprising:

a support member coupled to the hull;

a housing mounted on said support member, said housing being mounted for limited angular movement about an axis that falls in a vertical plane which passes through a center line of the hull;

a propeller shaft supported by and coupled to said housing, said propeller shaft being connected to said propeller;

means for transmitting power from said engine to said propeller shaft to rotate said propeller;

a shroud mounted on said housing encirling said propeller and concentric with said propeller shaft;

at least one rudder mounted partially within said shroud on the slipstream side of said propeller, said rudder being mounted for limited angular movement about a generally upright axis;

at least one air foil pivotably mounted partially within said shroud above said rudder on the slipstream side of said propeller, said air foil being mounted for limited angular rotation about a generally horizontal axis.

63. The steering apparatus of claim 62, wherein angular movement for said rudder is slaved to the angular movement of said housing.

64. The steering apparatus of claim 63, wherein angular movement of said rudder is related to angular movement of the propeller housing by an angular displacement ratio, said angular displacement ratio being from about 1:1 to about 4:1.

65. The steering apparatus of claim 62, wherein said support member and said axis of rotation are inclined from a lower end to an upper end of said support member towards the rear of the hull.

66. The air boat of claim 1, wherein said rudder means is pivotally mounted to said propeller mounting means about an axis generally parallel to said upright axis.

67. The airboat of claim 66, wherein said rudder means pivots about said parallel axis in response to rotational movement of said propeller mounting means.

68. The propulsion drive train of claim 10, wherein said noise reducing material comprises a corrugated, multi-apertured material.

69. The propulsion drive train of claim 68, wherein an absorbent material is positioned between the corrugated material and the inner surface of the shroud.

* * * * *